US007096764B2

(12) United States Patent
Dong

(10) Patent No.: US 7,096,764 B2
(45) Date of Patent: Aug. 29, 2006

(54) PIPE WRENCH

(75) Inventor: Zhigang Dong, Beijing (CN)

(73) Assignee: FASMAC PTE LTD, Singapore (SG)

( * ) Notice: Subject to any disclaimer, the term of this patent is extended or adjusted under 35 U.S.C. 154(b) by 0 days.

(21) Appl. No.: 10/096,097

(22) Filed: Mar. 12, 2002

(65) Prior Publication Data

US 2002/0121162 A1 Sep. 5, 2002

Related U.S. Application Data

(63) Continuation of application No. PCT/SG00/00146, filed on Sep. 13, 2000.

(30) Foreign Application Priority Data

Sep. 13, 1999 (CN) ..... ZL 99 2 44513
Sep. 8, 2000 (CN) ..... 00 1 24337

(51) Int. Cl.
*B25B 13/28* (2006.01)

(52) U.S. Cl. ..... 81/99; 81/111

(58) Field of Classification Search ..... 81/98, 81/99, 111, 186, 92–94, 97
See application file for complete search history.

(56) References Cited

U.S. PATENT DOCUMENTS 1,442,351 A 1/1923 Martin
1,577,789 A * 3/1926 Conway ..... 81/98
2,028,406 A 1/1936 Mead
2,057,899 A * 10/1936 Lucas ..... 81/99
D143,898 S * 2/1946 Brintnall ..... 81/99
2,441,144 A 5/1948 Gregory
2,559,973 A 7/1951 Kunz
2,559,974 A * 7/1951 Kunz ..... 81/99
2,958,246 A * 11/1960 Osborn ..... 81/99
5,251,518 A * 10/1993 Woo ..... 81/99
6,742,419 B1 * 6/2004 Chartier et al. ..... 81/99
2004/0154440 A1 * 8/2004 Chartier et al. ..... 81/99

* cited by examiner

*Primary Examiner*—Lee D. Wilson
(74) *Attorney, Agent, or Firm*—Nath & Associates PLLC; Harold L. Novick

(57) ABSTRACT

A Pipe Wrench with: reasonable coordination on distance between—Center of Arcuate Teeth and Link-Hole, eccentric length of Tips of Arcuate Teeth and Link-Hole; Instant Grip and Release, Time-Saving, Power-Saving, easy Operation is disclosed. It is composed of Heading-Hook, Main Body, Arcuate Jaw-Block, Spring-Guard Plate, Spring, Oil-Rope, Pin and Screw Bolt. The Jaw-Block designed by two (2) different sizes of Arc is inlaid in Slot B on Handle, due to designed size of Link-Hole being eccentric from center of Arcs of Jaw-Block is well coordinated with Arcs on Tip Teeth of Jaw-Block, which enables this Invention with Reliable and Firm Self-Lock on workpiece as well as its Open-Width being enlarged.

20 Claims, 3 Drawing Sheets

(4) Spring guard plate
(5) Spring
(6) Oil-Rope
(7) Pin
(8) Screw Bolt
(B) Slot to install Jaw- Block
(H) Hook ( hang spring )
(U) Spring housing

PIPE WRENCH

RELATED APPLICATIONS

This application is a Continuation which claims priority under 35 U.S.C. 111(a) to PCT Application No PCT/SG00/00146 filed 13 Sep. 2000, the entirety of which is incorporated herein by reference.

FIELD OF INVENTION

This invention relates to a kind of hand tool with a function of gripping and clamping.

BACKGROUND

Common Pipe Wrench is made with Leading Screw and Screw Nut, the adjustment of its opening and closing is realized by coordination between these two (2) parts, continuous regulating is needed being operated, waste time and manpower, the workpiece is easily damaged, due to its device; in addition, causing non-average pressure on workpiece and slippage. The existing Pipe Wrench has also function of 3-pointed contact on workpiece, but its Operating Open-Width does not come up to the requirement being operated, resulted from irrational device on the distance between Heading-Hook and Top-Teeth of Arcuate Jaw-Block and the distance between the Centers of Arc of Jaw-Block Teeth-Tips+Heading-Hook teeth-Tips and Pin Hole, leading to inconvenience to operation.

The aim of this invention is to avoid above mentioned inadequateness, supplying a sort of Pipe Wrench with good performance, larger size of Operating Open-Width, reliable gripping, instant locking, manpower-save, convenient operation that resulted from reasonable design in coordination of the distance between center of Arcuate Teeth and Linking Hole, eccentric distance between Tip of Arcuate Teeth and Link-Hole.

SUMMARY

In accordance with an aspect of the invention, A Pipe Wrench is provided, which comprises: Heading-Hook; Main Body; Arcuate Jaw-Block; Spring-Guard Plate; Spring; Oil-Rope; Pin; and Screw Bolt, wherein the Jaw-Block formed by two (2) different Arcs on its top Face is inlaid in Slot B on Main Body, the Horizontal Line P on top of Arcuate Jaw-Block has a distance of 20 mm~50 mm away from Horizontal Central Line O of Link-Hole A; the $1^{st}$. Arcuate Line from Point C~Point, and $2^{nd}$. Arcuate Line from Point D~Point E that connected with $1^{st}$. Arcuate Line, Vertical Extended Line of Central Point F of $1^{st}$. Arcuate Line of Jaw-Block is away from Central Line O of Link-Hole A for a distance of 8 mm~65 mm, Central Point F of $1^{st}$. Arcuate Line on Jaw-Block has a distance of 10 mm~43 mm away horizontally from Vertical Extended Line Q of the Center of Link-Hole, wherein the distance between Vertical Extended Line of Central Point m—the center of $2^{nd}$. Arcuate line of Jaw-Block being connected with $1^{st}$. Arcuate Line from Point D~Point E and Horizontal Central Line O of Link-Hole A is for a distance of 2 mm~33 mm, the Horizontal Line N of Point m—the Center of $2^{nd}$. Arcuate Line being connected with $1^{st}$. Arcuate Line from Point D~Point F is apart from Vertical Extended Central Line Q of Link-Hole for a distance of 16 mm~62 mm; the horizontal Line G is away from Central Line O of Link-Hole A for a distance of 26 mm~58 mm.

BRIEF DESCRIPTION OF DRAWING

Embodiments of the invention are described with reference to the following drawing, in which.

DETAILED DESCRIPTION

Figure 1A:
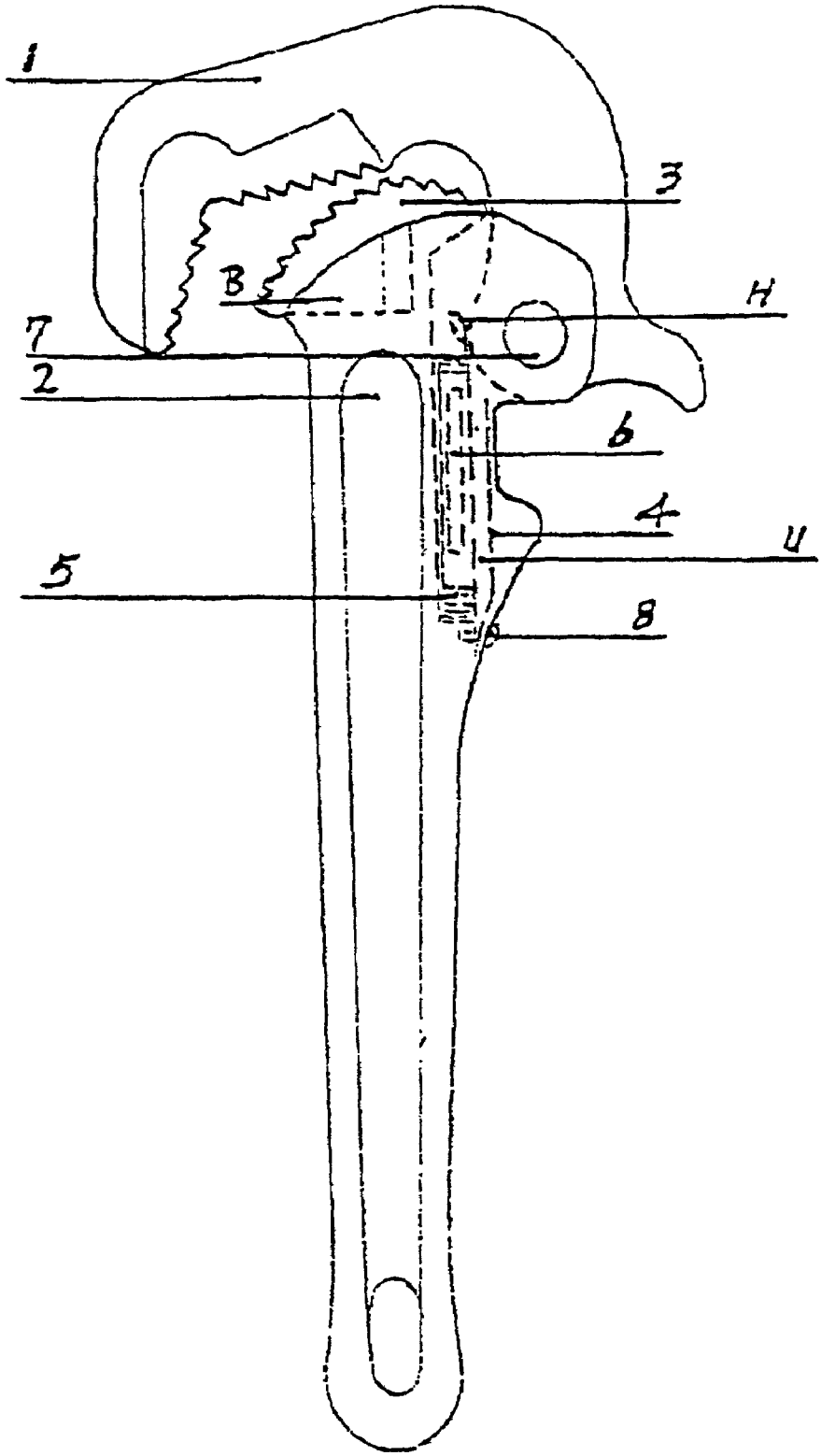
FIGS. 1*a* and 1*b* show the structure of a Pipe Wrench with hidden views, the Pipe Wrench according to an embodiment of the invention.

To actualize abovementioned aim, a Pipe Wrench according to embodiments of the, invention is designed as a V-Typed Heading-Hook with teeth arrayed on its inboard face, the angle of V Typed Heading-Hook is between 110°~125° and laid into/between the Link Position of the Main Body, a Pin is inserted into Link-Hole A, the Jaw-Block formed by two (2) different Arcuate Lines is inlaid into Slot B of the Main Body, the distance between Horizontal Line P of Teeth-Tips of Jaw-Block and Central Horizontal Line O of Link-Hole A is 2 mm~50 mm, the angle of $1^{st}$. Arcuate Line from Point C~Point D of the Jaw-Block is R30 mm~R120 mm, the angle of $2^{nd}$. Arcuate Line connected with $1^{st}$, Arcuate Line from Point D~Point E is R20 mm~R90 mm; the distance between Extended Line S being vertical to Central Point F of $1^{st}$. Arcuate Line of Jaw-Block and Central Line O of Link-Hole A is 8 mm~65 mm, the Center F of $1^{st}$. Arc of Jaw-Block crossed to the Extended Central Line Q of Link-Hole A with a distance scope of 10 mm~43 mm, the Extended Central Line of Center m of Arc between Point D and Point E for a distance of 28 mm~33 mm, the Horizontal Line N of the Center m of $2^{nd}$. Arcuate Line from Point D to Point E connecting with $1^{st}$. Arcuate Line is away from Vertical Extended Central Line Q of Link-Hole O for a distance of 26 mm~58 mm, the Horizontal Central Line G of Heading-Hook is vertically apart from Central Line O of Link-Hole A by a distance of 26 mm~58 mm; one End of a Spring with Oil-Rope inside is fixed on Place H of Heading-Hook, the other End is set into Spring Slot U, and Spring-guard Plate is fixed into Place U of Main Body. Due to reasonable coordination on designed measurement between Link-Hole A being eccentric from Arc Center of Jaw-Block and equitable linkage of the two (2) Arcuate Lines of Teeth Tips of Jaw-Block, which has made this invention with: Firm Self-Grip, as well as more Open-Width of Working Jaws; Heading-Hook is opened instantly being pressed on its Small Press-Button, putting it onto workpiece, the Working Jaws Grip firmly on workpiece while the Main Body is pushed, lifting Main Body to release quickly; the more pressure made on Main Body, the more tightness of locking will have; release is realized instantly while Main Body is lift up, the reliability of Grip is enhanced as well as more Open-Width and convenience.

The structure of the Pipe Wrench according to embodiments of the Invention has reasonable device on cooperative measurements between both of: Horizontal Line 0 of Link-Hole A and Tips of Arc-Shaped Jaw-Block, Center of Link-Hole A and Arc Centers of the Teeth on Jaw-Block, guaranteeing not only the Reliable Grip, but enlarged Open Width of Working Jaws. The damageable Jaw-Block is made of Alloy Steel to enhance its reliability and Life-Time. The Spring-Guard Plate that covered on top of Spring-Slot is to protect possible damages to the Spring; Oil-Rope is inserted into the hole of Spring for the Aim of Anti-Rust and enhancement of Life-Time and keeping fine tension, non-escape of workpiece, and made this kind of Pipe Wrench possible with Firm Grip at any position within its limits being operated and ample External-Force on workpiece. The Heading-Hook is opened quickly while being operated by pressing the Press-Button on Heading Hook, to place Pipe Wrench onto the workpiece, press Main Body, the Heading-Hook self grips firmly the workpiece; release is actualized by lifting up the Main Body lightly after operation, Quick and Flexible, Reliable and Convenient, Manpower-Save and Time-Save, High Efficiency.

Figure 1B:
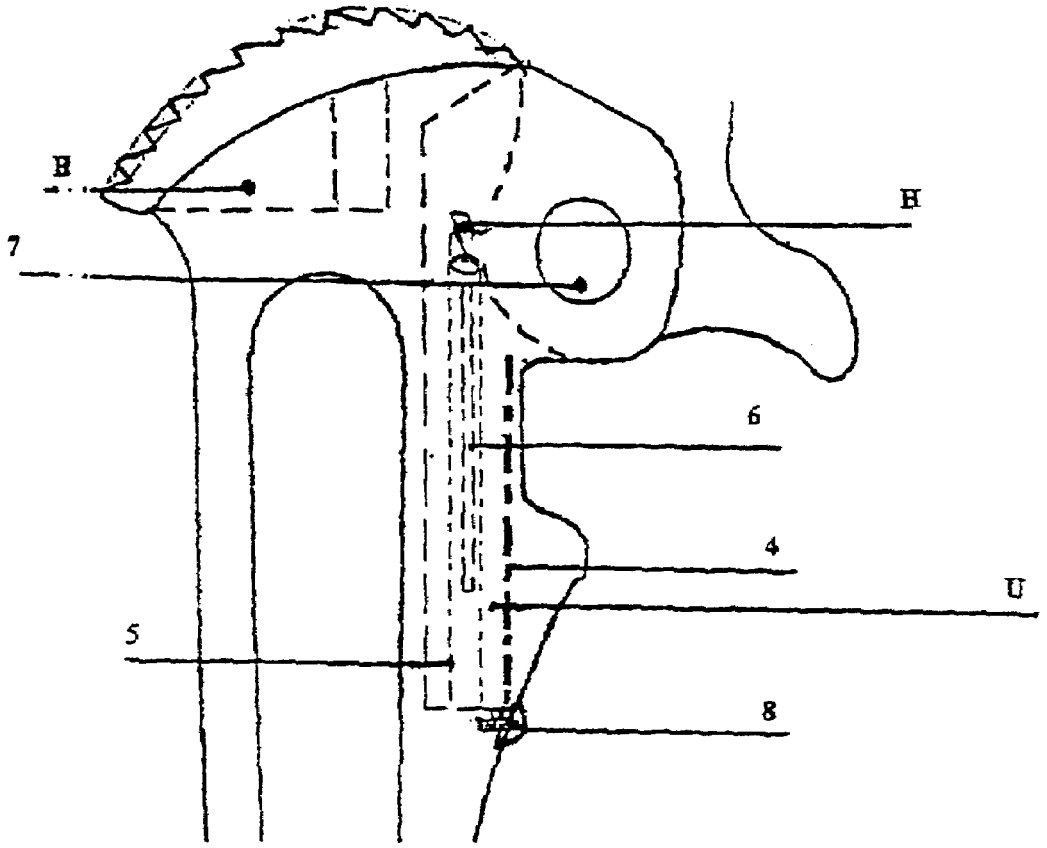
Figure 2:
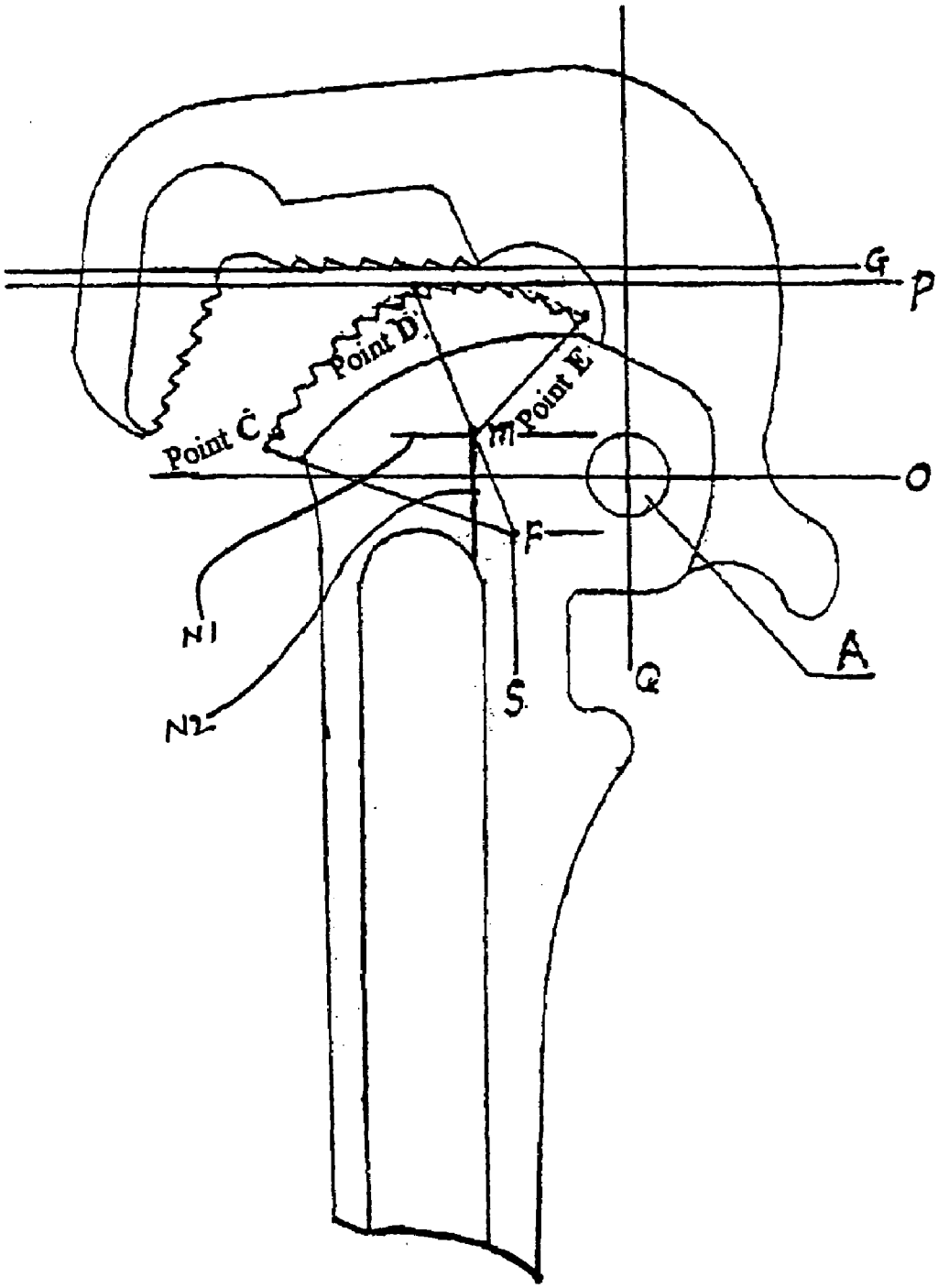
FIG. 2 shows the structure of a part of the Pipe Wrench of FIG. 1*a*.

Within FIGS. 1*a* and 1*b*: (1) Heading-Hook; (2) Main Body; (3) Arcuate Jaw-Block; (4) Spring-Guard Plate; (5) Spring; (6) Oil-Rope; (7) Pin; (8) Screw Bolt;

Within FIG. 2: (A) Link-Hole of Heading-Hook and Main Body; (B) Slot to fix Jaw-Block; (P) Horizontal Line of Teeth Tips on Arcuate Jaw-Block; (O) Horizontal Central Line of Link-Hole A; (Point C~Point D) $1^{st}$. Arcuate Line of Jaw-Block; (Point D~Point E) $2^{nd}$. Arcuate Line connected with $1^{st}$. Arcuate Line of Jaw-Block; (F) Center of $1^{st}$. Arcuate Line of Jaw-Block; (S) Vertical Extended Line of Center of $1^{st}$. Arcuate Line of Jaw-Block; (Q) Vertical Extended Line of Center of Link-Hole; (m) Center of $2^{nd}$. Arcuate Line of Jaw-Block; (N) Horizontal Extended Line of Center of $2^{nd}$. Arcuate Line of Jaw-Block; (G) Horizontal Central Line of Heading-Hook;

A pipe wrench according to a preferred embodiment of the invention is described hereinafter with reference to the attached figures. The pipe wrench is comprises: (1) a heading-hook; (2) a main body; (3) an arcuate jaw-block; (4) a spring-guard plate; (5) a spring; (6) an oil-rope; (7) a pin; and (8) a screw bolt. As illustrated in FIGS. 1*a* and 1*b* the heading-hook is connected to the main body at pivot point A. The heading-hook is shaped as a V with an angle of 115° and with teeth arrayed on its inboard face. The heading-hook is connected to the main body by a pin inserted into a hole at pivot point A. The jaw-block is formed by two different arcuate lines and is inlaid into slot B of the main body. The vertical distance between horizontal line P and horizontal central line O is 27 mm. The arc from point C to point D has a curvature center point F on a vertical line S. Point E is apart from horizontal central line O by 9 mm, and is away horizontally from vertical extended line Q by a distance of 16 mm. Vertical extended line N2 intersecting the curvature center point m of the second arcuate line from Point D to point E is at a distance of 18 mm from vertical central line Q. Horizontal central line G of is away from central line O by 28 mm. One end of the spring, which is loaded with the oil-rope therein, is attached to a small hook H. The other end of the spring is fixed into spring slot U on the main body, and the spring-guard plate is fixed therein to the main body by one screw bolt. Due to the above-described reasonable coordination of the designed distances, reliability of grip is ensured, together with enlarged opening width. The heading-hook is made of #20 Chrome Steel being forged or Precisely Cast Steeled, hardened after being partiy machined. The jaw-block being inlaid on the main body is mad of #60 Alloy Steel with main ingredients of Silicon, Manganese and Molybdenum, forged or Precisely Cast Steeled, and to be quenched after machined. The pipe wrench of the present invention provides: a wider opening width, a reliable grip, quick self-lock and release, and easier time-saving and power-saving operation.

What is claimed is:

1. A pipe wrench, comprising:

a main body for providing a handle;

a fixed jaw coupled to the main body, the fixed jaw being formed by at least two arcing jaw faces that are congruent and extend away from the main body;

an angled jaw pivotably coupled to the main body for interacting with the fixed jaw for clamping, the angled jaw having at least two substantially straight jaw faces which face the at least two arcing jaw faces at an angle to each other for providing a three-point grip in conjunction with the fixed jaw during clamping; and a pivot disposed on the main body adjacent to the fixed jaw for pivotably coupling the angled jaw to the main body, wherein the angle between said at least two substantially straight jaw faces of the angled jaw is obtuse and a radius of curvature of a first arc subtending the arcing jaw face proximal to the pivot is smaller than a radius of curvature of a second arc subtending the arcing jaw face distal to the pivot.

2. The wrench as in claim 1, wherein the fixed jaw is removably coupled to the main body.

3. The wrench as in claim 2, where the fixed jaw is removably coupled to the main body by being inserted into a slot in the main body.

4. The wrench as in claim 1, further including a biasing means for biasing the angled jaw towards the fixed jaw for clamping.

5. The wrench as in claim 1, wherein the jaw faces have gripping surfaces.

6. The wrench as in claim 5, wherein the gripping surfaces have teeth.

7. The wrench as in claim 1, wherein a longitudinal separation between the pivot and an extremity of the fixed jaw furthest away from the main body is 20 to 50 mm.

8. The wrench as in claim 1, wherein a longitudinal separation between the pivot and an extremity of one of the substantially straight jaw faces of the angled jaw which is proximal to the pivot nearest to the main body is 26 to 58 mm.

9. The wrench as in claim 1, wherein a longitudinal separation between the pivot and a center point of the larger arcing jaw face is 8 to 65 mm.

10. The wrench as in claim 1, wherein a transverse separation between the pivot and a center point of the larger arcing jaw face is 10 to 43 mm.

11. The wrench as in claim 1, wherein a longitudinal separation between the pivot and a center point of the smaller arcing jaw face is 2 to 33 mm.

12. The wrench as in claim 1, wherein a transverse separation between the pivot and a center point of the smaller arcing jaw face is 16 to 62 mm.

13. The wrench as in claim 1, wherein a radius of curvature of an arc subtending the larger arc jaw face is 30 to 120 mm.

14. The wrench as in claim 13, wherein a radius of curvature of an arc subtending the smaller arc jaw face is 20 to 90 mm.

15. A pipe wrench, comprising:

a main body for providing a handle;

a fixed jaw being removably coupled to the main body, the fixed jaw being formed by at least two arcing jaw faces that are congruent and extend away from the main body;

an angled jaw pivotably coupled to the main body for interacting with the fixed jaw for clamping, the angled jaw having at least two substantially straight jaw faces which face the at least two arcing jaw faces at an angle to each other for providing a three-point grip in conjunction with the fixed jaw during clamping;

a pivot disposed on the main body adjacent to the fixed jaw for pivotably coupling the angled jaw to the main body; and a biasing means for biasing the angled jaw towards the fixed jaw for clamping, wherein the angle between said at least two substantially straight jaw faces of the angled jaw is obtuse and a radius of curvature of a first arc subtending the arcing jaw face proximal to the pivot is smaller than a radius of curvature of a second arc subtending the arcing jaw face distal to the pivot.

16. A pipe wrench, comprising:

a main body for providing a handle;

a fixed jaw coupled to the main body, the fixed jaw being formed by at least two arcing jaw faces that are congruent and extend away from the main body;

an angled jaw pivotably coupled to the main body for interacting with the fixed jaw for clamping, the angled jaw having at least two substantially straight jaw faces which face the at least two arcing jaw faces at an angle to each other for providing a three-point grip in conjunction with the fixed jaw during clamping;

a pivot disposed on the main body adjacent to the fixed jaw for pivotably coupling the angled jaw to the main body; and a biasing means for biasing the angled jaw towards the fixed jaw for clamping, wherein the angle between said at least two substantially straight jaw faces of the angled jaw is obtuse and a radius of curvature of a first arc subtending the arcing jaw face proximal to the pivot is smaller than a radius of curvature of a second arc subtending the arcing jaw face distal to the pivot.

17. The wrench as in claim 16, wherein the fixed jaw is removably coupled to the main body.

18. The wrench as in claim 17, wherein the fixed jaw is removably coupled to the main body by being inserted into a slot in the main body.

19. The wrench as in claim 16, wherein a longitudinal separation between the pivot and an extremity of the fixed jaw furthest away from the main body is 20 to 50 mm, a longitudinal separation between the pivot and an extremity of the substantially straight jaw on the angled jaw proximal to the pivot nearest to the main body is 26 to 58 mm, a longitudinal separation between the pivot and a center point of the larger arcing jaw face is 8 to 65 mm, a transverse separation between the pivot and the center point of the larger arcing jaw face is 10 to 43 mm, a longitudinal separation between the pivot and a center point of the smaller arcing jaw face is 2 to 33 mm, and a transverse separation between the pivot and the center point of the smaller arcing jaw face is 16 to 62 mm.

20. The wrench as in claim 16, wherein a radius of curvature of a first arc subtending the larger arc jaw face is 30 to 120 mm, and a radius of curvature of a second arc subtending the smaller arc jaw face is 20 to 90 mm.

* * * * *

UNITED STATES PATENT AND TRADEMARK OFFICE

CERTIFICATE OF CORRECTION

PATENT NO. : 7,096,764 B2
APPLICATION NO. : 10/096097
DATED : August 29, 2006
INVENTOR(S) : Zhigang Dong It is certified that error appears in the above-identified patent and that said Letters Patent is hereby corrected as shown below:

Claims

Please change claims as followings;

Col. 4, line 2

1. A pipe wrench comprising:

a main body having a longitudinal axis and an outer surface;

a fixed jaw coupled to the main body, the fixed jaw having at least two arcing jaw faces that are congruent and extend away from the main body;

an angled jaw pivotably coupled to the main body, the angled jaw having at least two substantially straight jaw faces forming an obtuse angle and extending toward the at least two arching jaw faces;

a pivot disposed on the main body adjacent the fixed jaw and pivotably engaged with the angled jaw, the pivot having a horizontal plane perpendicular to the main body longitudinal axis; and wherein a first arcing jaw face center of curvature is disposed below the horizontal plane of the pivot and a second arcing jaw face center of curvature is disposed above the horizontal plane of the pivot.

Col. 4, line 22

2. The wrench as in claim 1, wherein the fixed jaw is removably coupled to the main body.

Col. 4, line 24

3. The wrench as in claim 2, wherein the fixed jaw is disposed in a slot in the main body.

Col. 4, line 27

4. The wrench as in claim 1, further included a means for biasing the angled jaw towards the fixed jaw.

Col. 4, line 30

5. The wrench as in claim 1, wherein the first and second centers of curvature lie within the main body outer surface.

Col. 4, line 32

6. The wrench as in claim 1, wherein the fixed jaw has only two congruent arcing jaw faces.

Col. 4, line 34

7. The wrench as in claim 1, wherein a longitudinal separation between a horizontal plane of the pivot and a horizontal plane of an extremity of the fixed jaw furthest away from the main body is 20 to 50mm.

UNITED STATES PATENT AND TRADEMARK OFFICE

CERTIFICATE OF CORRECTION

PATENT NO. : 7,096,764 B2
APPLICATION NO. : 10/096097
DATED : August 29, 2006
INVENTOR(S) : Zhigang Dong It is certified that error appears in the above-identified patent and that said Letters Patent is hereby corrected as shown below:

Claims (cont'd)

Col. 4, line 37
8. The wrench as in claim 1, wherein a longitudinal separation between a horizontal plane of the pivot and a horizontal plane of the portion of the at least two substantially straight jaw faces nearest the main body is 26 to 58mm Col. 4, line 42
9. The wrench as in claim 1, wherein a longitudinal separation between a horizontal plane of the pivot and the first center of curvature is 8 to 65mm.

Col. 4, line 45
10. The wrench as in claim 1, wherein a transverse separation between a vertical plane of the pivot and the first center of curvature is 10 to 43mm.

Col. 4, line 48
11. The wrench as in claim 1, wherein a longitudinal separation between a horizontal plane of the pivot and the second center of curvature is 2 to 33mm.

Col. 4, line 51
12. The wrench as in claim 1, wherein a transverse separation between a vertical plane of the pivot and the second center of curvature is 16 to 62 mm.

Col. 4, line 54
13. The wrench as in claim 1, wherein a first arcing jaw face radius of curvature is 30 to 120 mm.

Col. 4, line 57
14. The wrench as in claim 13, wherein a second arcing jaw face radius of curvature is 20 to 90 mm.

Col. 4, line 60
15. A pipe wrench comprising:

a main body;

a fixed jaw coupled to the main body, the fixed jaw having only two arcing jaw faces that are congruent and extend away from the main body;

an angled jaw pivotal coupled to the main body, the angled jaw having at least two substantially straight jaw faces and;

a pivot disposed on the main body adjacent the fixed jaw and pivotably engaged with the angled jaw.

UNITED STATES PATENT AND TRADEMARK OFFICE

CERTIFICATE OF CORRECTION

PATENT NO. : 7,096,764 B2
APPLICATION NO. : 10/096097
DATED : August 29, 2006
INVENTOR(S) : Zhigang Dong It is certified that error appears in the above-identified patent and that said Letters Patent is hereby corrected as shown below:

Claims (cont'd)

Col. 5, line 16
16. A pipe wrench comprising:
a main body having an outer surface;
a fixed jaw coupled to the main body, the fixed jaw having at least two arcing jaw faces that are congruent and extend away from the main body;
an angled jaw pivotal coupled to the main body, the angled jaw having at least two substantially straight jaw faces;
a pivot disposed on the main body adjacent the fixed jaw and pivotably engaged with the angled jaw;
a means for biasing the angled jaw towards the fixed jaw; and
wherein a first arcing jaw face center of curvature and a second arcing jaw face center of curvature lie within the main body outer surface.

Col. 6, line 7
17. The wrench as in claim 15, wherein the pivot has a horizontal plane perpendicular to a longitudinal axis of the main body, and the first arcing jaw face center of curvature is disposed below the horizontal plane and the second arcing jaw face center of curvature is disposed above the horizontal plane of the pivot.

Col. 6, line 9
18. The wrench as in claim 15, wherein the centers of curvature of the two arcing jaw faces lie within an outer surface of the main body.

Col. 6, line 12
19. The wrench as in claim 15, further including a means for biasing the angled jaw towards the fixed jaw, and a lubricating wick disposed adjacent the biasing means.

UNITED STATES PATENT AND TRADEMARK OFFICE

CERTIFICATE OF CORRECTION

PATENT NO. : 7,096,764 B2
APPLICATION NO. : 10/096097
DATED : August 29, 2006
INVENTOR(S) : Zhigang Dong It is certified that error appears in the above-identified patent and that said Letters Patent is hereby corrected as shown below:

Claims (cont'd)

Col. 6, line 26
20. The wrench as in claim 16, further including a lubricating wick disposed adjacent the biasing means.

Signed and Sealed this

Seventh Day of August, 2007

JON W. DUDAS
*Director of the United States Patent and Trademark Office*

US007096764C1

(12) EX PARTE REEXAMINATION CERTIFICATE (7864th)

United States Patent

Dong

(10) Number: US 7,096,764 C1

(45) Certificate Issued: Nov. 9, 2010

(54) PIPE WRENCH

(75) Inventor: Zhigang Dong, Beijing (CN)

(73) Assignee: FASMAC PTE Ltd., Singapore (SG)

Reexamination Request:
No. 90/009,269, Sep. 5, 2008

Reexamination Certificate for:

| | |
|---|---|
| Patent No.: | **7,096,764** |
| Issued: | **Aug. 29, 2006** |
| Appl. No.: | **10/096,097** |
| Filed: | **Mar. 12, 2002** |

Certificate of Correction issued Aug. 7, 2007.

Related U.S. Application Data

(63) Continuation of application No. PCT/SG00/00146, filed on Sep. 13, 2000.

(51) Int. Cl.
*B25B 13/28* (2006.01)

(52) U.S. Cl. ..... 81/99; 81/111

(58) Field of Classification Search ..... 81/99, 81/164, 165, 170

See application file for complete search history.

(56) References Cited

U.S. PATENT DOCUMENTS

| | | | | |
|---|---|---|---|---|
| 754,509 | A | | 3/1904 | Snider |
| 868,127 | A | | 10/1907 | Richards |
| 1,281,020 | A | | 10/1908 | Johnson |
| 1,065,552 | A | | 6/1913 | Russ |
| 1,449,477 | A | | 3/1923 | Wiley |
| 1,468,529 | A | | 9/1923 | Vivarttas |
| 1,495,676 | A | | 5/1924 | Coxe |
| 1,577,789 | A | | 3/1926 | Conway |
| 1,780,789 | A | | 11/1930 | Lanz |
| 1,929,258 | A | * | 10/1933 | Petersen et al. ..... 81/164 |
| 2,559,973 | A | * | 7/1951 | Kunz ..... 81/99 |
| 2,645,145 | A | | 7/1953 | Larson |
| 2,993,398 | A | * | 7/1961 | Schlote ..... 81/170 |
| 3,180,948 | A | | 4/1965 | McCarty |
| 3,307,244 | A | | 3/1967 | De Shong |
| 4,047,447 | A | | 9/1977 | Culver et al. |
| 5,251,518 | A | * | 10/1993 | Woo ..... 81/99 |

FOREIGN PATENT DOCUMENTS

| | | |
|---|---|---|
| DE | 173725 | 9/1904 |
| GB | 684240 | 12/1952 |

OTHER PUBLICATIONS

Federal Specification "Wrenches: Pipe Wrench and Basin Wrench"; GGG–W–651E; Mar. 11, 1988 (p. 1–6).

* cited by examiner

*Primary Examiner*—Jimmy G Foster

(57) ABSTRACT

A Pipe Wrench with: reasonable coordination on distance between—Center of Arcuate Teeth and Link-Hole, eccentric length of Tips of Arcuate Teeth and Link-Hole; Instant Grip and Release, Time-Saving, Power-Saving, easy Operation is disclosed. It is composed of Heading-Hook, Main Body, Arcuate Jaw-Block, Spring-Guard Plate, Spring, Oil-Rope, Pin and Screw Bolt. The Jaw-Block designed by two (2) different sizes of Arc is inlaid in Slot B on Handle, due to designed size of Link-Hole being eccentric from center of Arcs of Jaw-Block is well coordinated with Arcs on Tip Teeth of Jaw-Block, which enables this Invention with Reliable and Firm Self-Lock on workpiece as well as its Open-Width being enlarged.

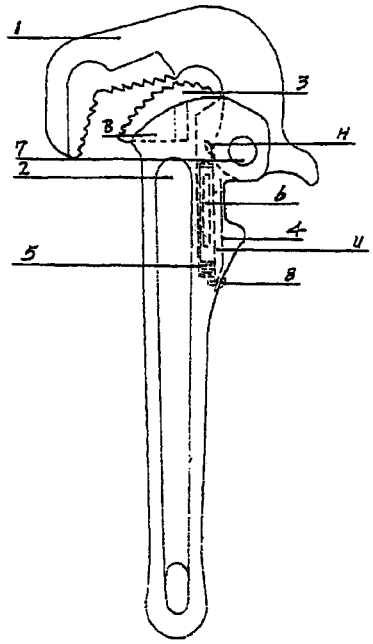

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 15-18 are cancelled.

Claims 1, 4, 19 and 20 are determined to be patentable as amended.

Claims 2, 3 and 5-14, dependent on an amended claim, are determined to be patentable.

New claims 21 and 22 are added and determined to be patentable.

1. A pipe wrench comprising:

a main body having a longitudinal axis and an outer surface;

a fixed jaw coupled to the main body, the fixed jaw having at least two arcing jaw faces that are congruent and extend away from the main body *between a first arc terminus and a second arc terminus*;

an angled jaw pivotably coupled to the main body, the angled jaw having at least two substantially straight jaw faces forming an obtuse angle and extending toward the at least two [arching] *arcing* jaw faces; *and* a pivot disposed on the main body adjacent the fixed jaw and pivotably engaged with the angled jaw, the pivot having a *center about which a* horizontal plane *of the pivot* perpendicular to the main body longitudinal axis [; and] *and a vertical plane of the pivot parallel to the main body longitudinal axis are definable,* wherein a first arcing jaw face center of curvature *corresponding to a first arcing jaw face distal to the pivot* is disposed below the horizontal plane of the pivot and a second arcing jaw face center of curvature *corresponding to a second arcing jaw face proximal to the pivot* is disposed above the horizontal plane of the pivot, *and*

*wherein the first arc terminus and the second arc terminus are transversely offset away from the vertical plane of the pivot in the same direction.*

4. The wrench as in claim 1, further [included] *comprising* a means for biasing the angled jaw towards the fixed jaw.

19. [The wrench as in claim 15, further including] *A pipe wrench comprising:*

*a main body;*

*a fixed jaw coupled to the main body, the fixed jaw having only two arcing jaw faces that are congruent and extend away from the main body;*

*an angled jaw pivotally coupled to the main body, the angled jaw having at least two substantially straight jaw faces;*

*a pivot disposed on the main body adjacent the fixed jaw and pivotably engaged with the angled jaw; and* a means for biasing the angled jaw towards the fixed jaw, and a lubricating wick disposed adjacent the biasing means.

20. [The wrench as in claim 16.] *A pipe wrench comprising:*

*a main body having an outer surface;*

*a fixed jaw coupled to the main body; the fixed jaw having at least two arcing jaw faces that are congruent and extend away from the main body;*

*an angled jaw pivotally coupled to the main body, the angled jaw having at least two substantially straight jaw faces;*

*a pivot disposed on the main body adjacent the fixed jaw and pivotably engaged with the angled jaw; and*

*a means for biasing the angled jaw towards the fixed jaw,*

*wherein a first arcing jaw face center of curvature and a second arcing jaw face center of curvature lie within the main body outer surface, and* further including a lubricating wick disposed adjacent the biasing means.

*21. The pipe wrench of claim 1, wherein the first arc terminus is distal to the pivot and the second arc terminus is proximal to the pivot.*

*22. The pipe wrench of claim 1, further comprising a press button coupled to the angled jaw, the press button horizontally extending away from the vertical plane of the pivot in a direction away from the fixed jaw.*

* * * * *